US010066359B2

(12) United States Patent
De Courcey et al.

(10) Patent No.: US 10,066,359 B2
(45) Date of Patent: Sep. 4, 2018

(54) COUPLER DEVICE

(71) Applicant: ORIEL FLUES LIMITED, Ardee (IE)

(72) Inventors: Thomas Martin De Courcey, Ardee (IE); Bartholomew James Cunningham, Ardee (IE)

(73) Assignee: Oriel Flues Limited, Louth (IE)

( * ) Notice: Subject to any disclaimer, the term of this patent is extended or adjusted under 35 U.S.C. 154(b) by 91 days.

(21) Appl. No.: 15/033,553

(22) PCT Filed: Sep. 30, 2014

(86) PCT No.: PCT/EP2014/070971
§ 371 (c)(1),
(2) Date: Apr. 29, 2016

(87) PCT Pub. No.: WO2015/049246
PCT Pub. Date: Apr. 9, 2015

(65) Prior Publication Data

US 2016/0281320 A1 Sep. 29, 2016

(30) Foreign Application Priority Data

Oct. 1, 2013 (GB) ..... 1317354.7

(51) Int. Cl.
*E02F 3/36* (2006.01)
*E02F 9/22* (2006.01)
*E02F 3/32* (2006.01)

(52) U.S. Cl.
CPC ..... *E02F 3/3618* (2013.01); *E02F 3/365* (2013.01); *E02F 3/3622* (2013.01); (Continued)

(58) Field of Classification Search
CPC ..... E02F 3/36–3/3695; E02F 9/2271
See application file for complete search history.

(56) References Cited

U.S. PATENT DOCUMENTS 6,902,346 B2 * 6/2005 Steig, Jr. ..... E02F 3/3618 37/468
6,964,122 B2 * 11/2005 Cunningham ..... E02F 3/3618 37/468

(Continued)

FOREIGN PATENT DOCUMENTS

EP 1 318 242 A2 11/2003
GB 2473942 A 3/2011

(Continued)

OTHER PUBLICATIONS

International Search Report, for International Appl. No. PCT/EP2014/070971, dated Sep. 4, 2015, consisting of 5 pages, entitled "A Coupler Device."

*Primary Examiner* — Robert Eric Pezzuto
*Assistant Examiner* — Adam J Behrens
(74) *Attorney, Agent, or Firm* — Hamilton, Brook, Smith & Reynolds, P.C.

(57) ABSTRACT

A coupler device for coupling an attachment to a mechanical arm of a machine or vehicle, comprising a main hitch body (2), an actuator (3) mounted to the main hitch body (2) and moveable relative to the main hitch body (2) and a front locking mechanism. The front locking mechanism comprises a first locking member (4) adapted to be pivoted by operation of the actuator (3) from an open position to a closed position to engage with a first pin or other means of an attachment to secure the attachment to the mechanical arm and a second locking member (6) provided on the main hitch body which is adapted to mount the actuator to the main hitch body when the first locking member is in its closed position such that the main hitch body prevents the first locking member (4) from pivoting into its open position.

12 Claims, 12 Drawing Sheets

(52) U.S. Cl.
CPC ..... *E02F 3/3663* (2013.01); *E02F 9/2271* (2013.01); *E02F 3/32* (2013.01)

(56) References Cited

U.S. PATENT DOCUMENTS 8,403,590 B2 * 3/2013 Hill ..... E02F 3/3618 172/272
8,782,931 B2 * 7/2014 Balemi ..... E02F 3/3618 37/468
9,217,235 B2 * 12/2015 Robl ..... E02F 3/3618
9,469,965 B2 * 10/2016 Hill ..... E02F 3/3618
2003/0204972 A1 * 11/2003 Cunningham ..... E02F 3/3618 37/403
2007/0157492 A1 * 7/2007 Miller ..... E02F 3/36 37/468
2007/0166143 A1 * 7/2007 Hart ..... E02F 3/3618 414/723
2009/0282712 A1 11/2009 Pruszynski
2010/0061799 A1 * 3/2010 Hill ..... E02F 3/3618 403/322.3
2010/0247228 A1 * 9/2010 Monaghan ..... E02F 3/3618 403/11
2010/0275474 A1 * 11/2010 Scheib ..... E02F 3/3618 37/468
2011/0209608 A1 9/2011 Stefek et al.
2011/0243654 A1 * 10/2011 Hill ..... E02F 3/3618 403/324
2012/0177472 A1 * 7/2012 Hill ..... E02F 3/3618 414/723
2012/0219356 A1 * 8/2012 Garland ..... E02F 3/3618 403/315
2012/0266432 A1 * 10/2012 Balemi ..... E02F 3/3618 29/426.1
2013/0234415 A1 * 9/2013 Essex ..... E02F 3/3618 280/504
2013/0318841 A1 * 12/2013 Robl ..... E02F 3/3618 37/468
2014/0294497 A1 * 10/2014 Robl ..... E02F 3/3622 403/376
2015/0330053 A1 * 11/2015 Ravindran ..... E02F 3/3618 29/426.5

FOREIGN PATENT DOCUMENTS

GB 2479221 A 10/2011
JP H11 29955 A 2/1999

* cited by examiner

COUPLER DEVICE

This application is the U.S. National Stage of International Application No. PCT/EP2014/070971, filed Sep. 30, 2014, which designates the U.S., published in English, and claims priority under 35 U.S.C. §§ 119 or 365(c) to GB Application No. 1317354.7, filed Oct. 1, 2013. The entire teachings of the above applications are incorporated herein by reference.

FIELD OF THE INVENTION

The invention relates to a coupler device. In particular the invention relates to a coupler device for coupling an attachment or accessory to a hydraulically operated arm of a machine, for example an excavator.

BACKGROUND TO THE INVENTION

Coupler devices are used on earth moving equipment for the removal and attachment of equipment such as buckets and rock breakers. The coupling device is commonly referred to as a 'quick coupler' or 'quick hitch'. These devices depend on positive hydraulic pressure and/or mechanical locks to hold buckets and other attachments in place. The use of quick coupler mechanisms on excavators and other earth moving equipment is common practice, as they allow operators to easily change buckets or attachments.

Where an excavator fitted with a Quick Coupler device is being operated, drivers should ensure the following before operating the machine:

1. The correct procedure for securing the attachment (bucket/rock breaker etc.) is employed and that the locking mechanism is fully deployed and secured.
2. Once the attachment is secured before use, and when all persons in the vicinity are sufficiently clear of the machine, the driver should aggressively shake the dipper arm to ensure that the attachment cannot come loose.

In some designs of quick couplers the point of contact between the pins and the locking member can be quite small. This feature, coupled with high concentrated loads, can lead to the problem that these bucket pins can wear and quickly loosen. Some couplers that have being designed for use with one particular make of excavator, with buckets and other tools then being designed for use with these excavators. This means that such couplers often cannot be used to pick up a bucket or attachments of another manufacturer. This can be a substantial disadvantage, especially on sites where there may be excavators from several different manufacturers all being operated by the same contractor. Some couplers have gravity operated release mechanisms that rely on the machine hydraulic oil that is supplied for the excavator for operation. However, in some cases the oil can have dirt or debits within the oil, which in turn may prevent the mechanism from operating. Another problem with existing couplers is that due to the loss of hydraulic pressure which may occur due to damage to the hydraulic cylinders, an attachment may be prevented from being removed.

Accordingly it is an object of the present invention to provide an improved coupler device to overcome at least one of the above mentioned problems.

SUMMARY OF THE INVENTION

According to the invention there is provided, as set out in the appended claims, a coupler device for coupling an attachment to a mechanical arm of a machine or vehicle, said coupler device comprising:

a main hitch body;

an actuator mounted to the main hitch body and moveable relative to the main hitch body; and a front locking mechanism comprising a first locking member adapted to be pivoted by operation of the actuator from an open position to a closed position to engage with a first pin or other means of an attachment to secure the attachment to the mechanical arm;

characterised in that:

the front locking mechanism further comprises a second locking member provided on the main hitch body which is adapted to mount the actuator to the main hitch body when the first locking member is in its closed position such that the main hitch body prevents the first locking member from pivoting into its open position.

In one embodiment there is provided a coupler device for coupling an attachment to a mechanical arm of a machine or vehicle, said coupler device comprising:

a first locking mechanism comprising a locking member adapted to pivot from an open position to a closed position to engage with a pin or other means to secure the attachment to the mechanical arm;

characterised in that:

the coupler device comprises a hitch adapted to cooperate with the locking member to provide a second locking mechanism when the first locking member engages with the pin.

It will be appreciated that the second locking mechanism on the front hook is to ensure that there is no premature release of the attachment. The coupler device of the present invention provides a simple design which has no greasing requirements and less maintenance and moving parts to ensure a hassle free Quick Coupler.

In one embodiment the locking member comprises a slot to accommodate the mounting member.

In one embodiment the slot comprises an open end and a closed end, and wherein the mounting member is adapted to slide into the open end of the slot and along the length of the slot to the closed end of the slot as the actuator pivots the first locking member from the open position to the closed position.

In one embodiment the mounting member is adapted to slide from the closed end of the slot along the length of the slot and out from the open end of the slot as the actuator pivots the first locking member from the closed position to the open position so as to release the front locking mechanism.

In one embodiment the slot is configured to force the motion of the actuator to change between linear motion and pivotal motion as the mounting member slides between the open end and the closed end.

In one embodiment the slot comprises an outer section of a first depth distal to the open end and an inner section of a second depth distal to the closed end, and a gradient section connecting the outer section to the inner section, and wherein the motion of the actuator is forced to change between linear motion and pivotal motion as the mounting member slides between the outer section and the gradient section.

In one embodiment the actuator is controlled by a hydraulic force or a manual actuator.

In one embodiment the actuator comprises a hydraulic ram.

In one embodiment there is provided a spring element positioned to maintain the first and the third locking members in place during use, and in the event the hydraulic force fails, the first and third locking members are acted on by the spring, which retains the attachment in case of a hydraulic fault.

In one embodiment the spring surrounds the hydraulic ram and the spring is encased with a cylindrical casing.

In one embodiment the cylindrical casing is adapted to allow oil to be passed from one end of the ram to the other end by a cylindrical extrusion.

In one embodiment the cylinder comprises a uni-directional valve.

In one embodiment there is provided a third locking member adapted to slide back and forth within the coupler and controlled by a locking ram.

In one embodiment the third locking member comprises a hook adapted to cooperate with a second pin to secure the attachment to the mechanical arm.

In one embodiment the hook comprises an anti-slip mechanism such that the hook is dimensioned to allow the second pin rest against the base of the hook in a seated position.

In one embodiment there is provided at least one stopper adapted to inhibit movement of the hook and allow the locking member to be lifted up to engage with the hitch.

In one embodiment the attachment is a bucket and the vehicle is an excavator.

BRIEF DESCRIPTION OF THE DRAWINGS

The invention will be more clearly understood from the following description of an embodiment thereof, given by way of example only, with reference to the accompanying drawings, in which.

DETAILED DESCRIPTION OF THE DRAWINGS

Figure 1:
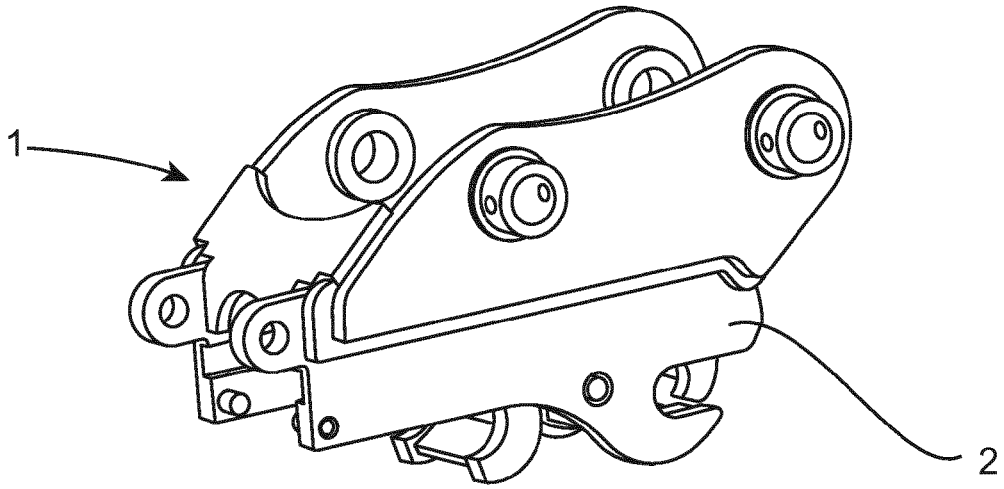
FIG. 1 illustrates a 3D side view of a coupler according to one embodiment of the invention.

FIG. 1 illustrates a 3D side view of a coupler according to one embodiment of the invention for coupling an attachment or accessory to a hydraulically operated arm of a machine, for example an excavator. It will be appreciated that the term 'attachment' and 'machine' should be interpreted broadly in the context of the present invention.

FIGS. 2 to 5 illustrate the coupler according to one embodiment of the invention. The coupler device or hitch 1 shown in FIGS. 2 to 5 comprises a main hitch body 2 and an actuator, which in this embodiment takes the form of a hydraulic ram 3, mounted to the main hitch body 2 and moveable relative to the main hitch body 2. The coupler device 1 provides a front locking mechanism comprising a first locking member adapted to pivot from an open position to a closed position to engage with a pin or other means to secure an attachment to the mechanical arm of a machine, for example an excavator. The front locking mechanism further comprises a second locking member provided on the main hitch body and adapted to mount the actuator to the main hitch body when the first locking member is in its closed position such that the main hitch body prevents the first locking member from pivoting into its open position.

In one embodiment the first locking member comprises a front hook 4, and the ram 3 is mounted to the main hitch body 2 by means of a ball and socket locking mechanism based on a ram mounting member 5 provided on the ram 3. The second locking member comprises a slot 6 to accommodate the ram mounting member 5.

In operation, the front locking mechanism is designed in a way that the main body 2 of the hitch 1 restricts the movement of the front hook 4 when the hitch 1 is in operation. As the front hook 4 pivots from the open position into the front locking or closed position by operation of the ram 3, the mounting member 5 slides back into the second locking member provided by the slot 6 in the main hitch body 2, which in turn allows the body 2 of the hitch to lock the front hook 4 into place in the closed position. This design is known as a sliding latch. The pivoting of the front hook 4 is controlled in this embodiment by a hydraulic force, for example by the ram 3 being hydraulically or pneumatically controlled and encased by a cylinder.

Figure 2:
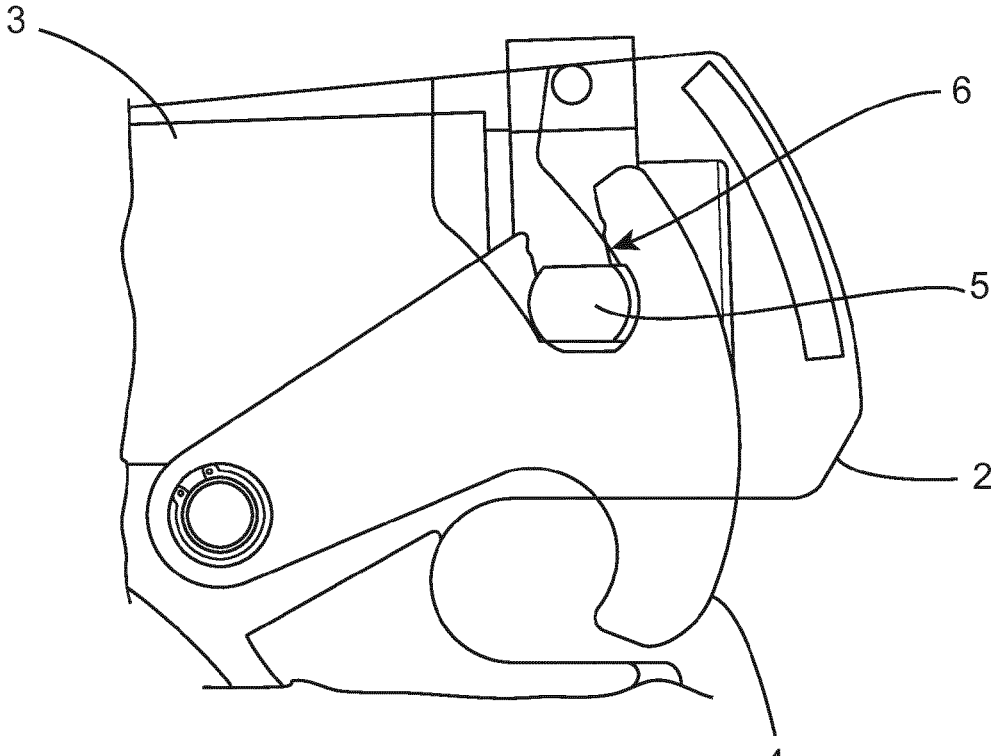
FIG. 2 illustrates a first locking member pivoting into a closed position, according to one embodiment of the invention.
Figure 3:
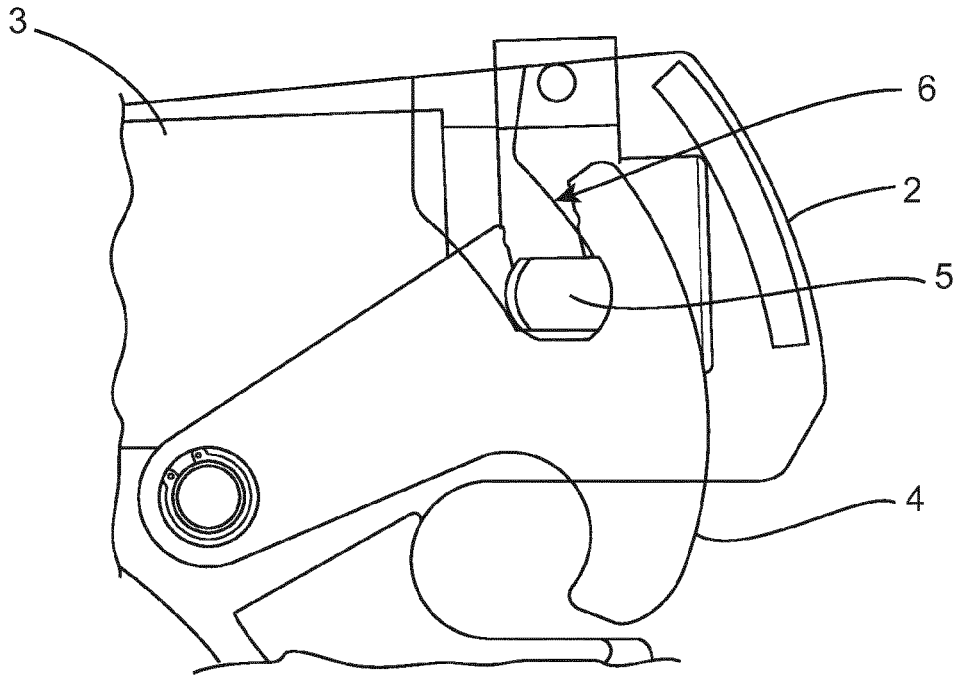
FIG. 3 illustrates a first and a second locking member in a closed position, according to one embodiment of the invention.

Thus, it will be appreciated that the hydraulic pressure within the cylinder forces the ram mounting member 5 into the slot 6 when the front hook 4 is being pivoted by the ram 3 into its closed position until such time the operator of the machine (not shown) wants to disengage the attachment. This is shown in FIGS. 2 and 3.

Figure 4:
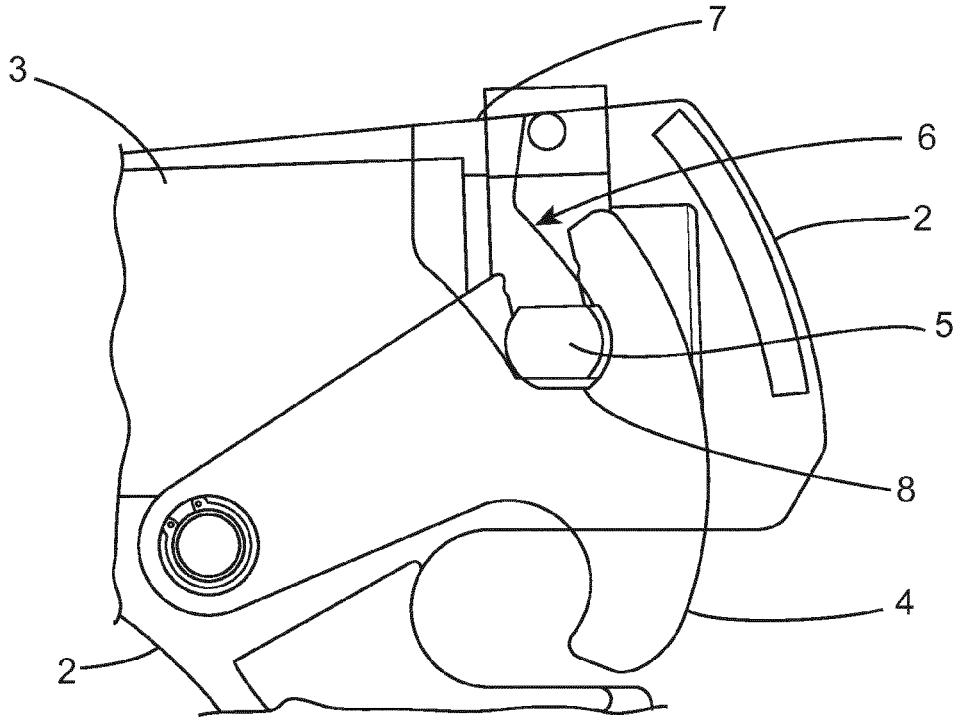
FIGS. 4 and 5 illustrates the first and second locking members in operation.
Figure 5:
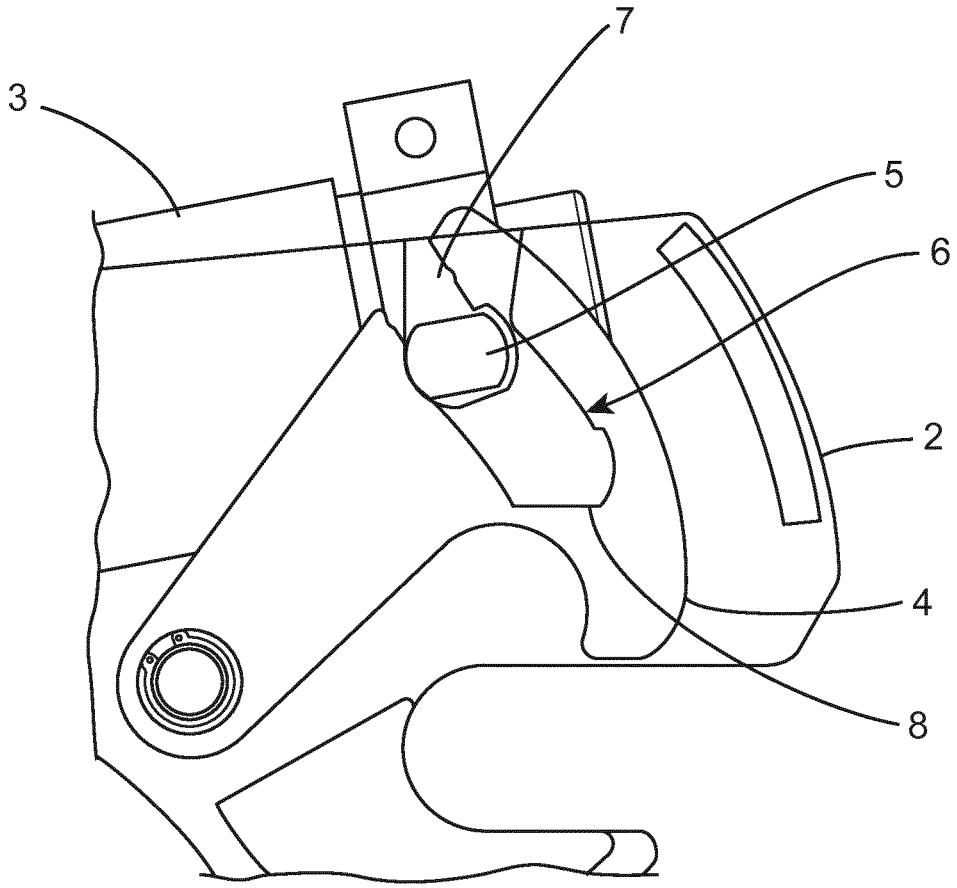
Figure 6:
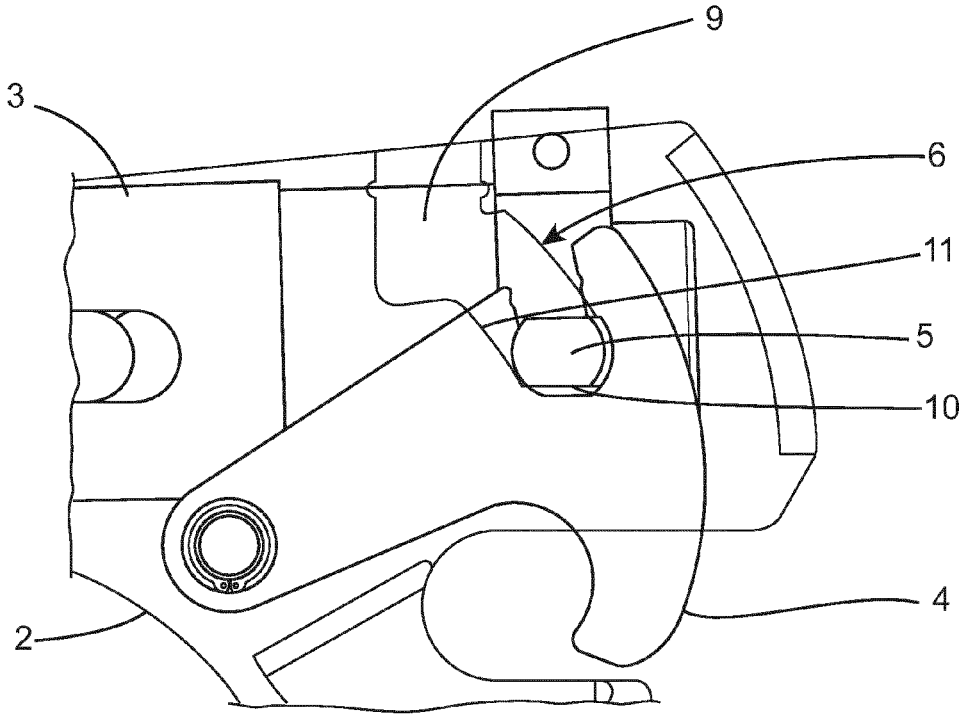
FIG. 6 illustrates a first locking member pivoting into a closed position, according to an alternative embodiment of the invention.
Figure 7:
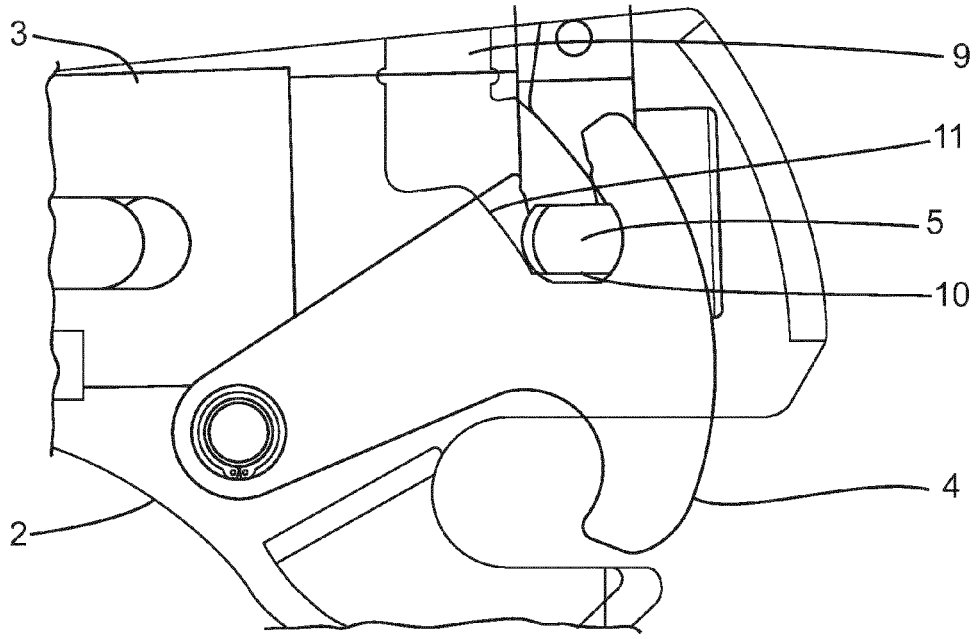
FIG. 7 illustrates a first and second locking members in a closed position, according to the alternative embodiment of the invention.
Figure 8:
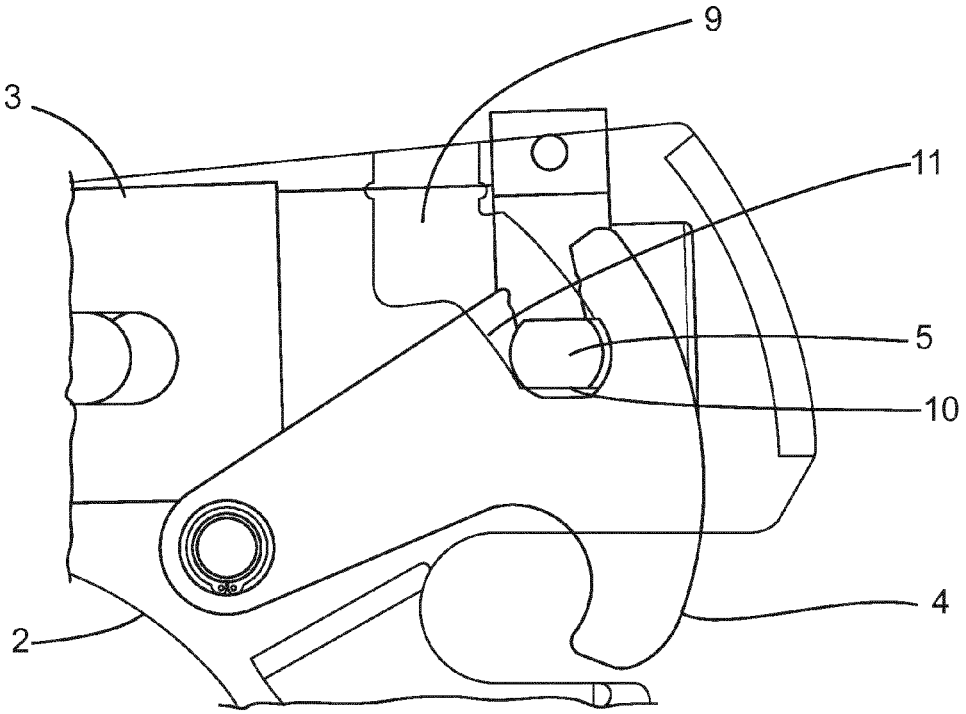
FIGS. 8 and 9 illustrates the first and second locking members in operation in the alternative embodiment of the invention.
Figure 9:
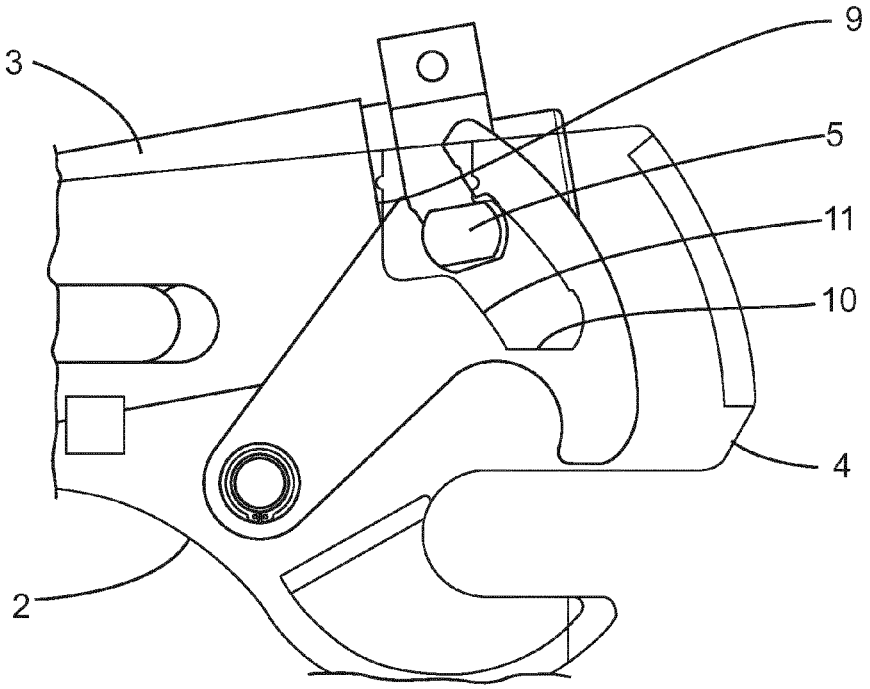
Figure 10:
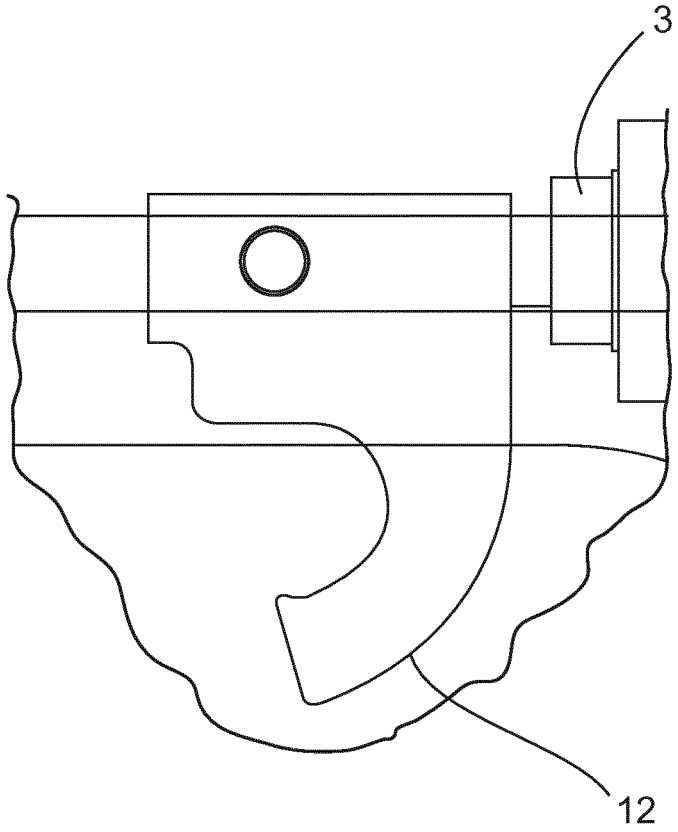
FIGS. 10 to 14 illustrate a third locking member according to another embodiment of the invention.
Figure 11:
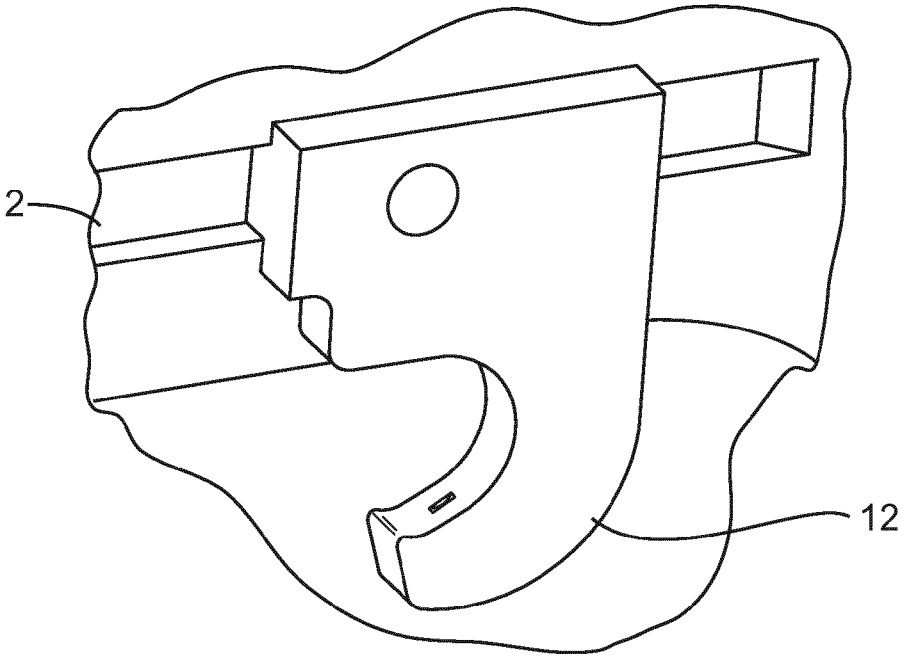
Figure 12:
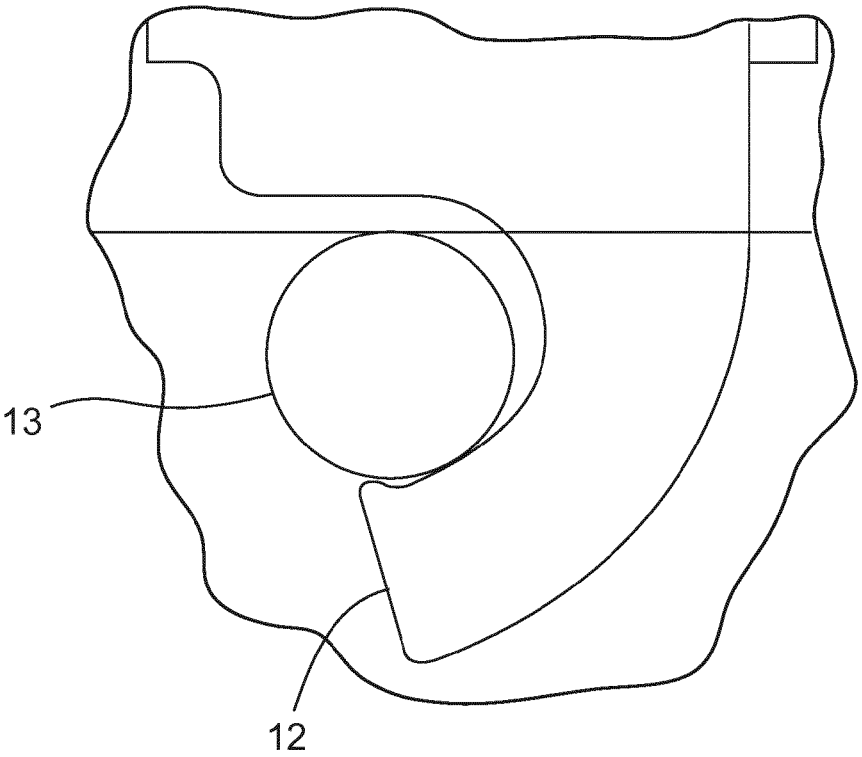

When the front locking mechanism is to be released by an operator (not shown), the ram 3 is energised in order to pivot the first locking member in the form of the front hook 4 from the closed position to the open position. The energising of the ram 3 causes the ram mounting member 5 to slide free from the slot 6 in the main body 2 of the hitch, and thus releases the front locking mechanism. As the ram 3 continues to energise and comes to a close it will pull the ram mounting member 5 clear of the slot 6 and begin to pivot the front hook 4 up into the main body 2 of the hitch. The attachment pin can then be released from the body of the hitch and the machine boom can move away, as shown in FIGS. 4 and 5.

As can be seen from FIGS. 2 to 5, the slot 6 comprises an open end 7 and a closed end 8. The mounting member 5 is adapted to slide into the open end 7 of the slot 6 and along the length of the slot to the closed end 8 of the slot 6 as the ram 3 pivots the front hook 4 from the open position to the closed position. Conversely, the mounting member 5 is adapted to slide from the closed end 8 of the slot 6 along the length of the slot 6 and out from the open end 7 of the slot as the ram 3 pivots the front hook 4 from the closed position to the open position so as to release the front locking mechanism.

In one embodiment of the invention, the slot 6 is configured to force the motion of the ram 3 to change between linear motion and pivotal motion as the mounting member slides between the open end and the closed end. This slot configuration is shown in FIGS. 6 to 9. The slot 6 comprises an outer section 9 of a first depth distal to the open end 7 and an inner section 10 of a second depth distal to the closed end 8, and a gradient section 11 connecting the outer section 9 to the inner section 10. In this configuration, the motion of the ram 3 is forced to change between linear motion and pivotal motion as the mounting member 5 slides between the outer section 9 and the gradient section 11.

FIGS. 10 to 14 illustrate a third locking member according to another embodiment of the invention in the form of a rear hook 12 positioned distal from the front locking mechanism. The rear hook 12 is designed in a way that it slides back and forth along a channel 17 provided within the main hitch body 2 which is caused by the movement of the hydraulic ram 3. The rear hook 12 is adapted to slide from an open position to a closed or locked position to engage with a second or rear pin 13 of the attachment to secure the attachment to the mechanical arm. The range of movement of the rear hook 12 depends on the distance between the two pin centres of the attachment. This centre distance can vary over the range of attachments. This sliding rear hook acts as a secondary locking feature on the hitch.

The rear hook has a unique anti-slip design which is another safety feature that this hitch brings to the market. The anti-slip design allows the back pin to rest against the base of the hook in a seated position. This prevents the pin centre from slipping away from the hook when the coupler is in operation.

Figure 13:
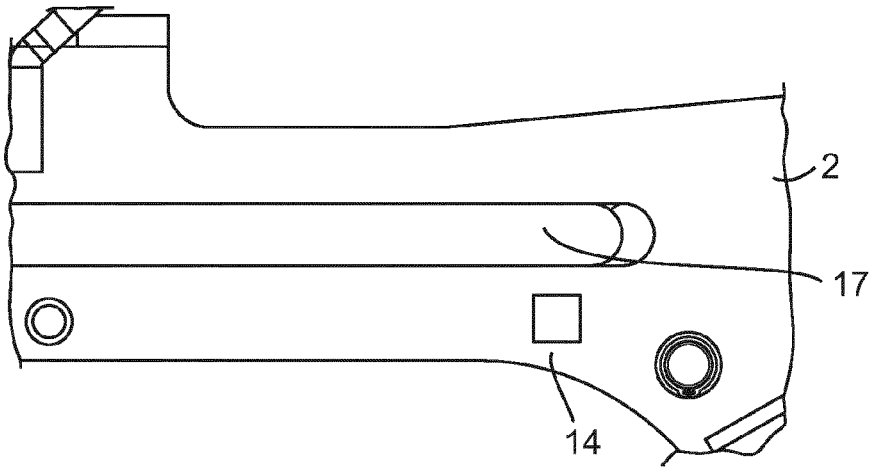
Figure 14:
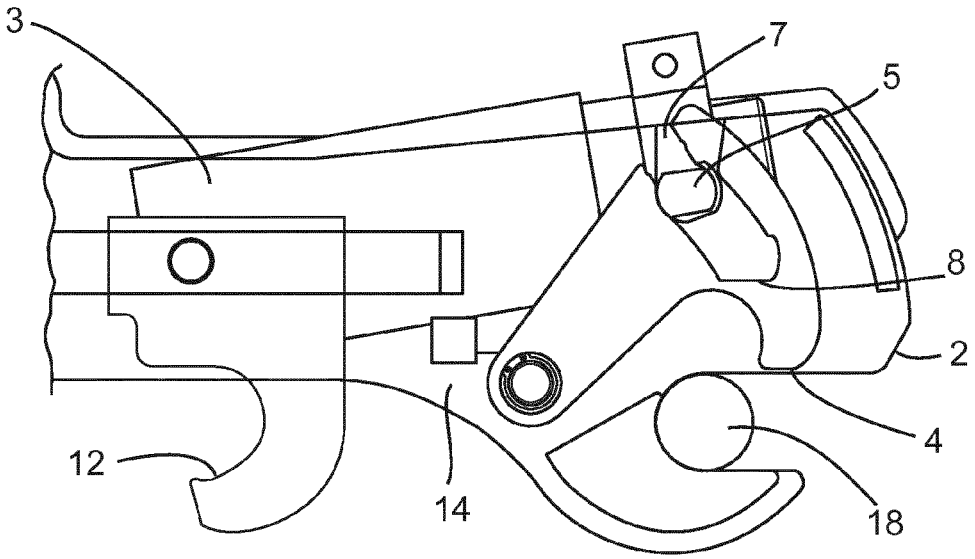

An added feature of the coupler device is two or more stoppers 14, two of which are found at the front of the rear hook, which are adapted to prevent the hook from over exerting, as shown in FIG. 13. Another pair of stoppers 14 can be located at the back of the rear hook 12, and adapted to inhibit the movement of the rear hook 12 to allow the ram 3 to release the front locking mechanism. This in turn allows the ram 3 to lift the front hook 4 up and into the main body 2 when pivoting the front hook 4 from the closed to the open position. FIG. 14 illustrates the stopper in operation. As the rear hook 12 hits the stopper 14, the ram 3 pivots the front hook 4 to lift it up to remove the first pin 18 of the attachment to disengage the coupler.

Another aspect to the front and rear hooks is that a marking or etching can be made where the hook engages at least one pin. Over time through use the marking can wear away. This thus provides a visual indicator to a user that the hooks need to be replaced.

Figure 15:
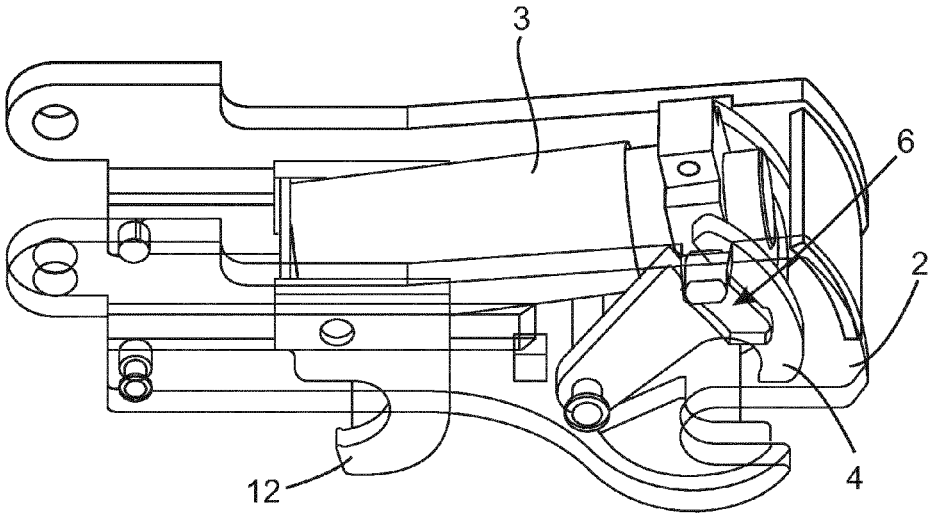
FIGS. 15 and 16 illustrate another embodiment of the coupler device according to the invention.
Figure 16:
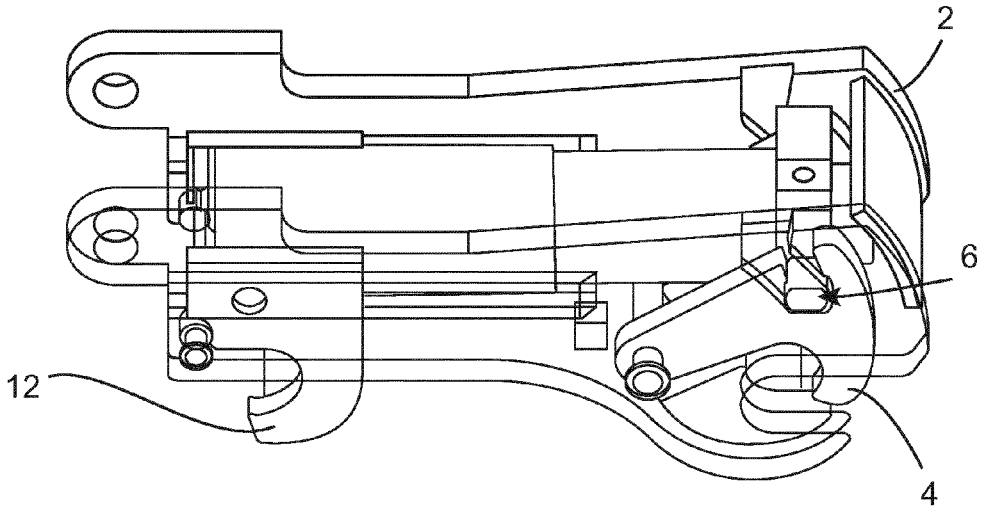

FIGS. 15 and 16 illustrate how the hydraulic cylinder is used to open and close the rear and front hooks and can be used to maintain them in position during operation. If the hydraulic system fails, which can happen in harsh working environments, the coupler device provides a safety spring to maintain the first and third locking members in place.

Figure 17:
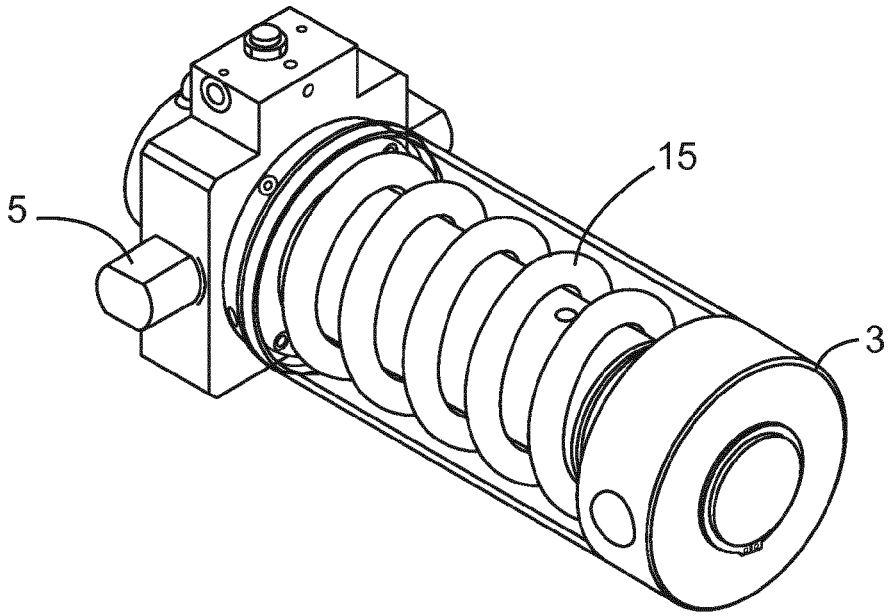
FIGS. 17, 18 and 19 illustrates a spring safety mechanism according to one embodiment of the invention.
Figure 18:
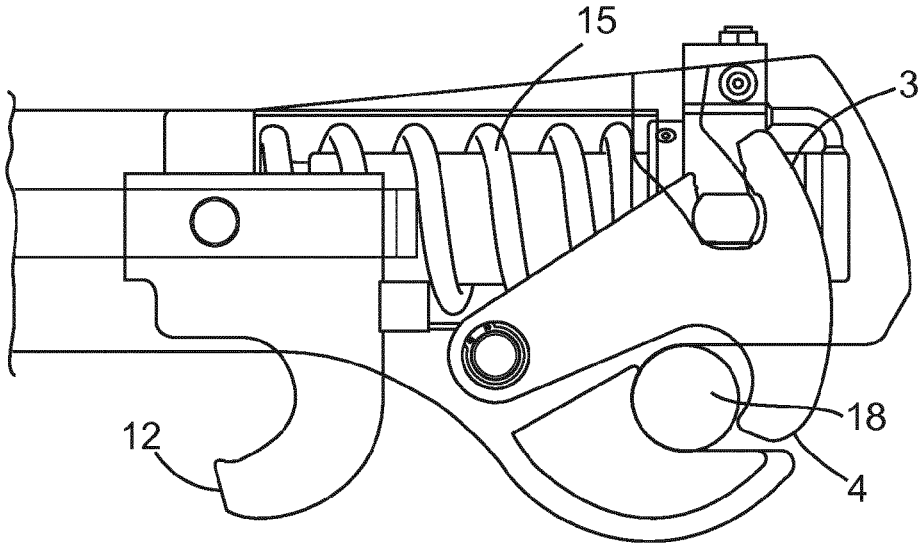
Figure 19:
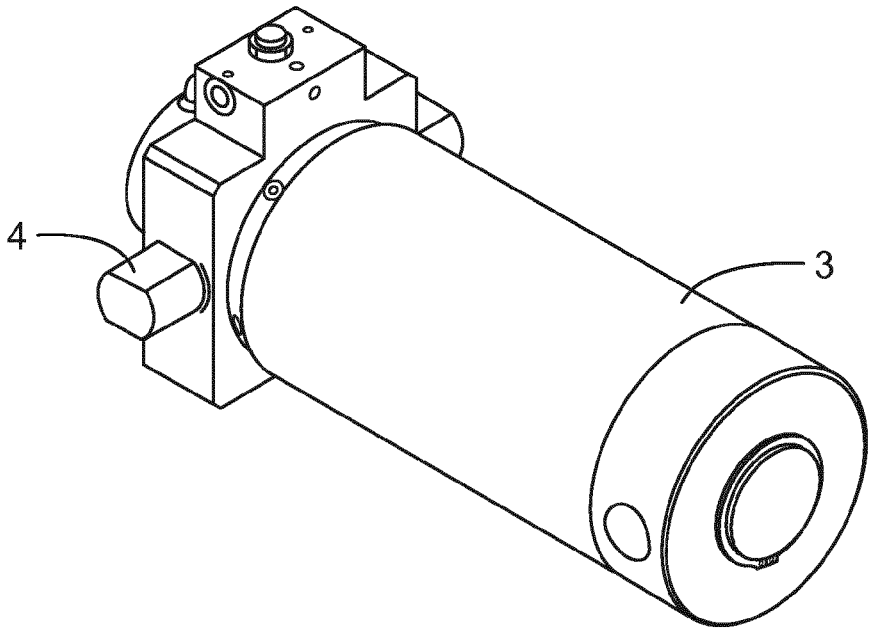

FIGS. 17, 18 and 19 illustrates a spring safety mechanism according to one embodiment of the invention. A spring 15 can be positioned to maintain the first and the third locking members in place during use, and in the event the hydraulic force fails. The spring 15 is preferably a heavy duty spring. The spring surrounds the hydraulic ram and the spring is encased with a cylindrical casing. A secondary component which makes up the ram is the heavy duty spring. This is a major safety feature which maintains the front and rear hooks in a locked position if or when a sudden failure occurs within the hydraulics or the ram, this will ensure the double locking mechanism held in position. For safety, this spring 15 is enclosed within a cylindrical cover which makes up the full encasement of the ram.

Figure 20:
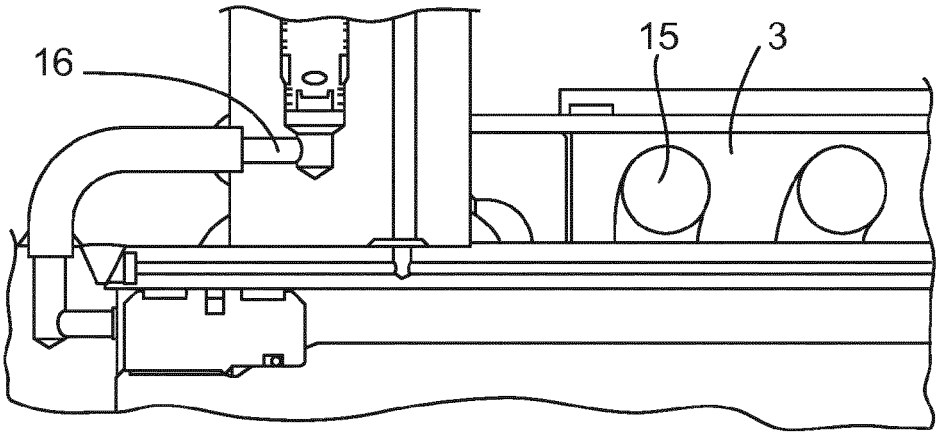
FIGS. 20 and 21 illustrate another embodiment of the coupler device according to the invention.
Figure 21:
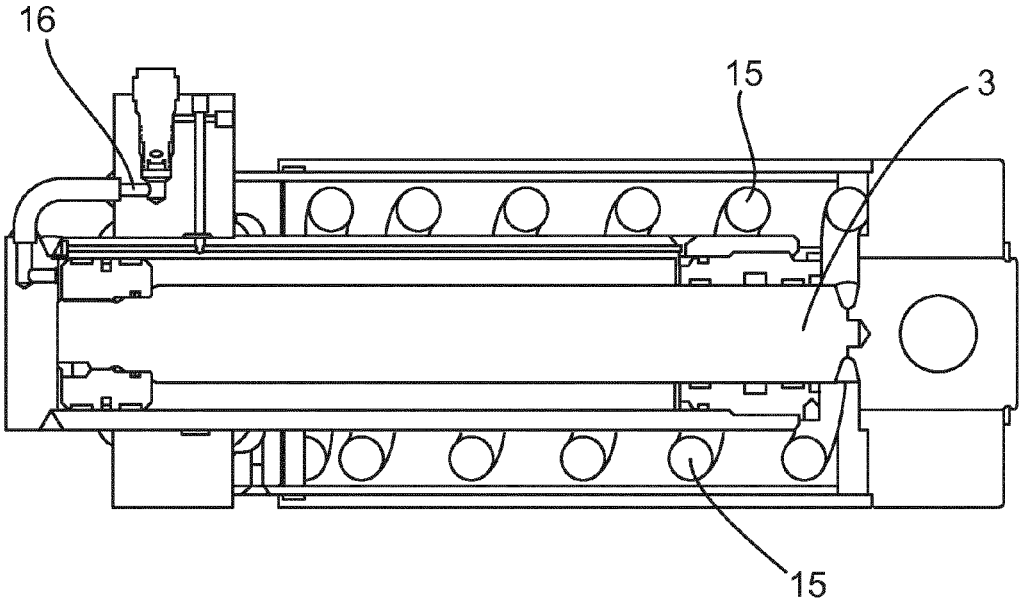

The unique design of the cylinder allows the hydraulic oil to be passed from one end of the ram to the other by a cylindrical extrusion which has been bored through the outer wall of the cylinder. This process allows movement within the ram. The hydraulic cylinder has a check valve 16 added. This is a safety feature that allows oil flow in one direction only, as shown in FIGS. 20 and 21.

In the specification the terms "comprise, comprises, comprised and comprising" or any variation thereof and the terms include, includes, included and including" or any variation thereof are considered to be totally interchangeable and they should all be afforded the widest possible interpretation and vice versa.

The invention is not limited to the embodiments hereinbefore described but may be varied in both construction and detail. For example, it should be appreciated that while in the described embodiment the actuator takes the form of a hydraulic ram, the actuator could equally well be provided by any suitable activation means, such as by a mechanical means.

The invention claimed is:

1. A coupler device for coupling an attachment to a mechanical arm of a machine or vehicle, said coupler device comprising:

a main hitch body;

an actuator mounted to the main hitch body and moveable relative to the main hitch body, wherein the actuator is provided with a mounting member to mount the actuator to the main hitch body; and a front locking mechanism comprising a first locking member adapted to be pivoted by operation of the actuator from an open position to a closed position to engage with a first pin of an attachment to secure the attachment to the mechanical arm;

the front locking mechanism further comprising a second locking member comprising a slot comprising an open end and a closed end provided on the main hitch body to accommodate the mounting member, wherein the slot comprises an outer section distal to its open end, an inner section distal to its closed end, and a gradient section connecting the outer section to the inner section;

such that as the actuator pivots the first locking member from the open position to the closed position, linear motion of the actuator slides the mounting member from the outer section of the slot to the gradient section of the slot, and pivotal motion of the actuator slides the mounting member from the gradient section of the slot to the inner section of the slot so that the first locking member is locked in the closed position.

2. The coupler device of claim 1, wherein the mounting member is adapted to slide from the closed end of the slot along the length of the slot and out from the open end of the slot as the actuator pivots the first locking member from the closed position to the open position so as to release the front locking mechanism.

3. The coupler device of claim 1, wherein the outer section of the slot comprises a first depth and the inner section of the slot comprises a second depth, and wherein the motion of the actuator is forced to change between linear motion and pivotal motion as the mounting member slides between the outer section and the gradient section.

4. The coupler device of claim 1 wherein the actuator is controlled by a hydraulic force or a mechanical actuation force.

5. The coupler device of claim 4 wherein the actuator comprises a hydraulic ram.

6. The coupler device of claim 1 further comprising a third locking member adapted to slide back and forth within the main hitch body and controlled by the actuator, wherein the third locking member is adapted to slide from an open position to a closed position to engage with a second pin of the attachment to secure the attachment to the mechanical arm.

7. The coupler device of claim 6 further comprising a spring element positioned to maintain the first and the third locking members in place during use and in the event the hydraulic force fails.

8. The coupler device of claim 7 wherein the spring surrounds the actuator and the spring is encased with a cylindrical casing.

9. The coupler device of claim 6 wherein the third locking member comprises a hook.

10. The coupler device of claim 9 wherein the hook comprises an anti-slip mechanism such that the hook is dimensioned to allow the second pin to rest against the base of the hook in a seated position.

11. The coupler device of claim 9 further comprising at least one stopper adapted to inhibit movement of the hook and allow the first locking member to be pivoted by the actuator from the closed position into the open position.

12. The coupler device of claim 1 wherein the attachment is a bucket and the vehicle is an excavator.

* * * * *